US008746741B2

(12) United States Patent
Gonzalez

(10) Patent No.: US 8,746,741 B2
(45) Date of Patent: Jun. 10, 2014

(54) TRUNCATED V UNDERBODY PROTECTION ENHANCEMENT

(71) Applicant: Rene' G. Gonzalez, Southfield, MI (US)

(72) Inventor: Rene' G. Gonzalez, Southfield, MI (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 76 days.

(21) Appl. No.: 13/677,202

(22) Filed: Nov. 14, 2012

(65) Prior Publication Data

US 2014/0130658 A1 May 15, 2014

(51) Int. Cl.
*B62D 21/15* (2006.01)
*F41H 5/16* (2006.01)
*F41H 7/02* (2006.01)

(52) U.S. Cl.
USPC ..... 280/784; 89/36.08; 296/187.08

(58) Field of Classification Search
USPC ..... 280/784, 788, 124.109, 770; 89/36.08, 89/930, 36.09, 36.02; 296/193.07, 84.1, 296/190.07, 199; 428/911; 180/232, 274, 180/311, 312
See application file for complete search history.

(56) References Cited

U.S. PATENT DOCUMENTS 2,097,309 A * 10/1937 Sanders, Jr. ..... 280/788
3,351,374 A 11/1967 Forsyth et al.
4,492,282 A 1/1985 Appelblatt et al.
6,557,929 B2 5/2003 Fox et al.
7,836,999 B2 * 11/2010 Kato ..... 180/312
7,905,534 B2 3/2011 Boczek et al.
8,033,208 B2 10/2011 Joynt et al.
8,418,594 B1 * 4/2013 Dunne et al. ..... 89/36.02
8,601,931 B2 * 12/2013 Naroditsky et al. ..... 89/36.08
2002/0153183 A1 * 10/2002 Puterbaugh et al. ..... 180/89.13
2006/0113784 A1 * 6/2006 Kishima ..... 280/784
2007/0234896 A1 10/2007 Joynt
2008/0066613 A1 3/2008 Mills et al.
2010/0307329 A1 12/2010 Kaswen et al.
2011/0017054 A1 * 1/2011 Naroditsky et al. ..... 89/36.02
2012/0174767 A1 7/2012 Naroditsky et al.
2012/0186428 A1 * 7/2012 Peer et al. ..... 89/36.02
2013/0264808 A1 * 10/2013 Gras et al. ..... 280/784

OTHER PUBLICATIONS energysuspension.com, Products: Performance Polyurethane Body,Truck Cab and Subframe Mounts, Internet, p. 1-3.
Google Search, Body Mount Pads, Internet, p. 1 of 13.

* cited by examiner

*Primary Examiner* — Drew Brown
(74) *Attorney, Agent, or Firm* — David L. Kuhn; Thomas W. Saur; Luis Miguel Acosta

(57) ABSTRACT

A mechanism protecting vehicle occupants from floor oscillation during under-vehicle explosions comprises vehicle cab sidewalls, a cab floor, cab mounts having elastomeric bodies between the cab and vehicle frame members, a shield below the cab floor, first elastomeric isolators between the shield and frame, and second elastomeric isolators between the shield and sidewalls. The second isolators collapse by an amount equal to the combined collapse of the first isolators and cab mounts. Explosive loads to the shield follow paths to different floor zones, decreasing floor oscillation. A vehicle payload area is mounted to the frame separately from the cab. The payload area and cab move independently on the frame. The payload area mounts are stiffer and smaller than the cab mounts, so explosions under the vehicle tend to accelerate the payload area before the cab.

17 Claims, 4 Drawing Sheets

TRUNCATED V UNDERBODY PROTECTION ENHANCEMENT

GOVERNMENT INTEREST

The invention described here may be made, used and licensed by and for the U.S. Government for governmental purposes without paying royalty to me.

BACKGROUND OF THE INVENTION

1. Field of the Invention

The invention is within the area of technology associated with protecting vehicles and their occupants from explosions of mines or improvised explosive devices typically encountered by military vehicles in combat zones. Generally this technology involves adding armor to the underside of vehicles and specially shaping the lower hulls of the vehicles; typically armored V-shaped hulls or somewhat V-shaped hulls are used to protect the vehicles and the vehicle occupants. One problem that has been encountered in some vehicle designs is that the floor of the cab or cabin of the vehicle oscillates violently as a result of an under-vehicle explosion. The oscillation is known to injure the occupants of the vehicle, the lower limbs of the occupants being particularly vulnerable to the effects of floor oscillation. The invention herein mitigates blast-induced floor oscillation by controlling the paths of blast forces passed to the floor and by providing force dampening isolators in each path. The invention also utilizes the inertia of vehicle components such as the drive train and cargo or payload area to absorb force loads originating from an under-vehicle explosion.

2. Background Art

It is already known to employ a truncated V shaped hull or a "shallow V" hull on a vehicle to enhance its ability to resist or survive mine blasts or similar explosions occurring under the vehicle. Such employment is shown, for example, by US Patent application 2008/0066613 A1 to Mills et al. Mills at FIG. 6 also shows an energy absorbing structure between the truncated V hull and the cab area. The energy absorption structure is comprised of a framework of sacrificial struts or beams reinforcing the lower vehicle hull. An underbody blast shield mounted to the vehicle via shock absorbers is shown in U.S. patent Application Publication 2010/0307329 A1 of Kaswen et al. U.S. Patent Application 2012/0174767 A1 for Naroditsky et al shows a shallow V belly armor plate under a vehicle cab and attached to sidewalls of a vehicle; the belly armor plate has an upper and lower layer between which is an energy absorbing structure. Drive train components have been used in prior art vehicles to absorb a portion of the blast force from explosions under the vehicle so that the vehicle hull experienced a reduced effect from the blast force, as seen in U.S. Pat. No. 4,492,282 to Appelblatt. More specifically, Appelblatt's FIG. 6 shows drive train elements beneath a generally "shallow V" shaped lower hull of a vehicle. Prior technology also shows using a component having high mass and inertia within the lower hull portion of a V-hull structure; see FIG. 3B and paragraph 0037 of US Patent Application 2007/0234896 A1 to Joynt, now issued as U.S. Pat. No. 7,357,062. Additionally, FIG. 2 of U.S. Pat. No. 8,033,208 B2 to Joynt shows components disposed between two lower hull V-shaped sections.

SUMMARY OF THE INVENTION

The invention is an improvement to vehicle structure; it is a mechanism for better protecting occupants of a vehicle from floor oscillation resulting from an explosion under the vehicle. The mechanism utilizes a pair of vehicle frame members and a vehicle cab having side walls and a floor fixed to the side walls; the mechanism preferably also utilizes a vehicle payload area, such as a load bed. Cab mounts having elastomeric bodies are disposed between the frame members and the cab, and payload area mounts having elastomeric bodies are disposed between the frame members and the payload area. The cab and payload area are mounted separately to the frame members and are not directly connected to each other, whereby relative motion between the cab and the frame members is independent of relative motion between the payload area and the frame members. The cab-mount elastomeric bodies are more compliant and vertically thicker than the elastomeric bodies of the payload-area mounts. By this design feature the payload area tends to be accelerated upward before the cab is, and the payload area absorbs force load from the blast before blast force load reaches the cab. A rigid shield made of armor material and configured as a truncated V is disposed below the floor of the cab. First elastomeric isolators are disposed between the shield and the frame members. Second elastomeric isolators are disposed between lateral edges of the shield and the cab's side walls. Automotive components, such as a vehicle transmission and a transfer case are affixed to the frame members at a position beneath the cab floor. In the event of an under-vehicle explosion, the distance through which the second isolators collapse is equal to the combined collapsing distance of the first isolators and the cab mounts, whereby explosive loads experienced by the shield travel along separate force paths to different zones of the floor so as to decrease oscillation of the floor.

DETAILED DESCRIPTION OF THE PREFERRED EMBODIMENT(S)

Definitions and Terminology

Figure 1:
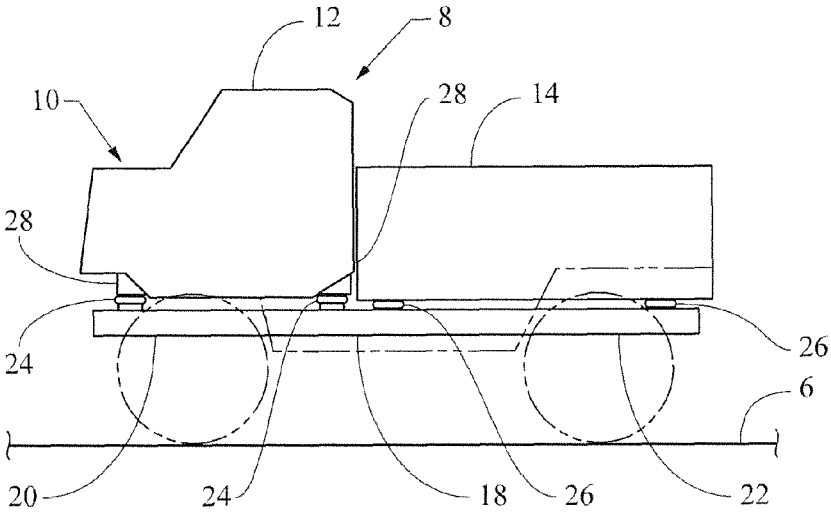
FIG. 1 is a side view of a vehicle on which the improved mechanism described above can be installed.

The following definitions and terminology are applied as understood by one skilled in the appropriate art.

The singular forms such as "a," "an," and "the" include plural references unless the context clearly indicates otherwise. For example, reference to "a material" includes reference to one or more of such materials, and "an element" includes reference to one or more of such elements.

As used herein, "substantial" and "about", when used in reference to a quantity or amount of a material, dimension, characteristic, parameter, and the like, refer to an amount that is sufficient to provide an effect that the material or characteristic was intended to provide as understood by one skilled in the art. The amount of variation generally depends on the specific implementation. Similarly, "substantially free of" or the like refers to the lack of an identified composition, characteristic, or property. Particularly, assemblies that are identified as being "substantially free of" are either completely absent of the characteristic, or the characteristic is present only in values which are small enough that no meaningful effect on the desired results is generated.

Concentrations, values, dimensions, amounts, and other quantitative data may be presented herein in a range format. One skilled in the art will understand that such range format is used for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a size range of about 1 dimensional unit to about 100 dimensional units should be interpreted to include not only the explicitly recited limits, but also to include individual sizes such as 2 dimensional units, 3 dimensional units, 10 dimensional units, and the like; and sub-ranges such as 10 dimensional units to 50 dimensional units, 20 dimensional units to 100 dimensional units, and the like.

Oscillation, as used in this application can include a single motion, such as the rise of a vehicle cab floor and can include the subsequent fall of the floor; oscillation, as used herein can include as a series of oscillating motions and includes motions in any given direction, not just a vertical direction.

For a vehicle, and a system mounted on or used in connection with the vehicle, forward/reverse (longitudinal) and vertical (up/down) directions are generally relative to the vehicle and system as typically operated (e.g., when the vehicle is operated with the respective powertrain in a forward/reverse mode). As such, lateral (left/right) directions are generally perpendicular to the longitudinal/vertical plane, and are referenced from a vehicle operator (e.g., driver) perspective. A first direction (e.g., forward) and a second direction (e.g., rearward or reverse) where the second direction substantially, but not necessarily wholly, opposes the first direction are also generally or used in connection with the vehicle. Likewise, elements located (mounted, positioned, placed, installed, etc.) on, near, or proximate to the vehicle body are generally referred to as "inner", while elements that are distal or more remote to the vehicle body are generally referred to as "outer", unless otherwise noted. As such, inner elements are generally closer to the vehicle body than outer elements.

In FIG. 1 is shown a vehicle 8 having a generic body-and-frame assembly 10 that is adapted to accommodate my shield comprised of a truncated underbody V structure. The shield enhances vehicle occupant protection from explosions beneath the vehicle. Assembly 10 includes a cab 12 and a cargo carrying unit or payload area 14 which can be a pick-up truck bed or an enclosed box-like container. Alternatively the payload area can be any other conventional cargo transport structure, such as, for example, a flat bed or a tank for transporting liquids. Assembly 10 has a pair of parallel frame members 18, which are each comprised of a fore frame member section 20 and an aft frame member section 22. The parallel relation between the frame members can be seen in FIGS. 3 and 6, wherein both fore frame member sections 20 are shown. Cab 12 and unit 14 are not connected directly to each other, although they are both attached to frame members 18 respectively by cab mounts 24 and payload area mounts 26. By this arrangement, relative motion between the cab and the frame members is independent of relative motion between the payload area and the frame members.

Figure 7:
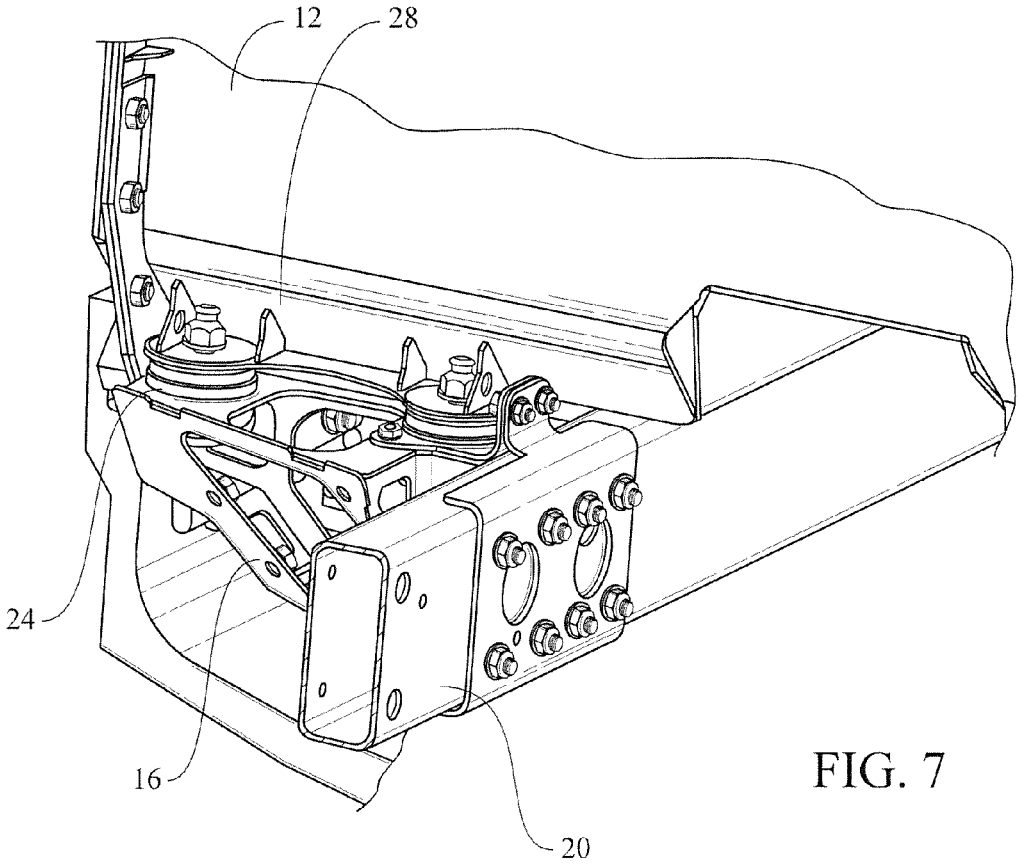
FIG. 7 is a detail view of the cab mount and immediately surrounding structure.

Normally, cab mounts 24 are attached to cab 12 by mount brackets 28 whereas payload area mounts 26 attach directly to cargo unit 14. In FIG. 7 is a detail view of a cab mount 24 and its connections to cab 12 and fore frame member section 20. Member section 20 has a frame arm 16 affixed to and extending laterally from member section 20. Cab 12 has brackets 28 affixed thereto. An elastomeric body of cab mount 24 is sandwiched between bracket 28 and frame arm 16. The respective mounts are conventional in structure and incorporate elastomeric bodies such as disks or toroid-shaped components which absorb or dampen shocks. Cab mounts 24 have softer, more compliant elastomeric bodies than do payload area mounts 26. Cab mounts 24 are thicker or of greater vertical dimension than the payload area mounts so that cab 14 is disposed further from frame members 18, than is payload area 14.

Figure 2:
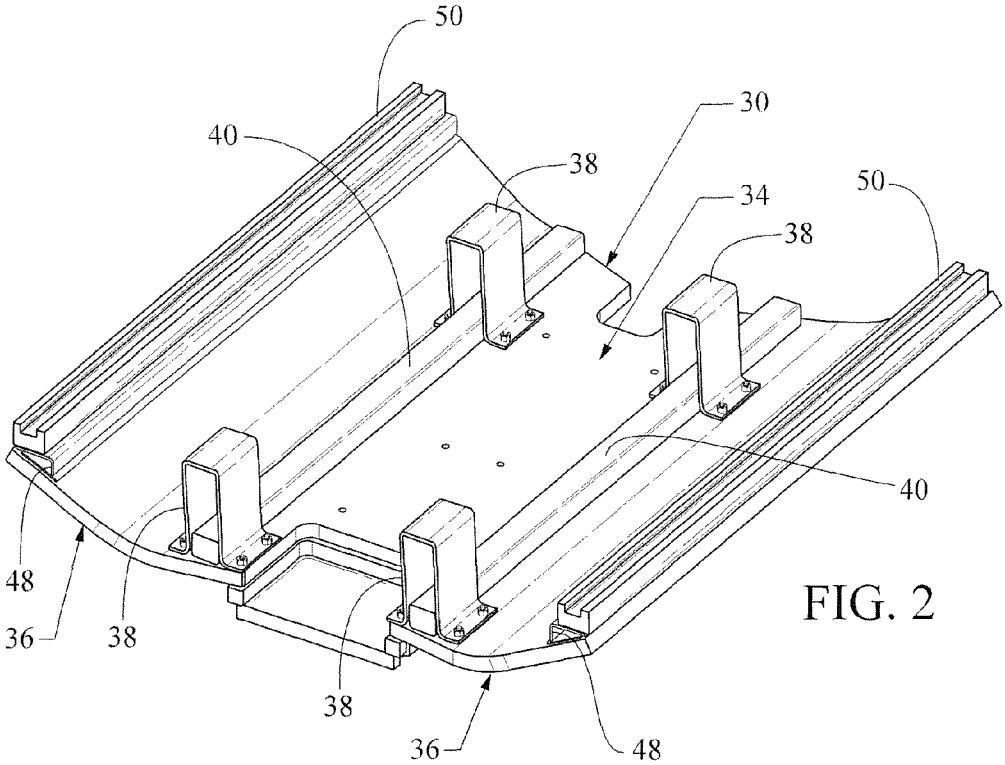
FIG. 2 is a perspective view of the shield and isolators which are elements of the invention.
Figure 3:
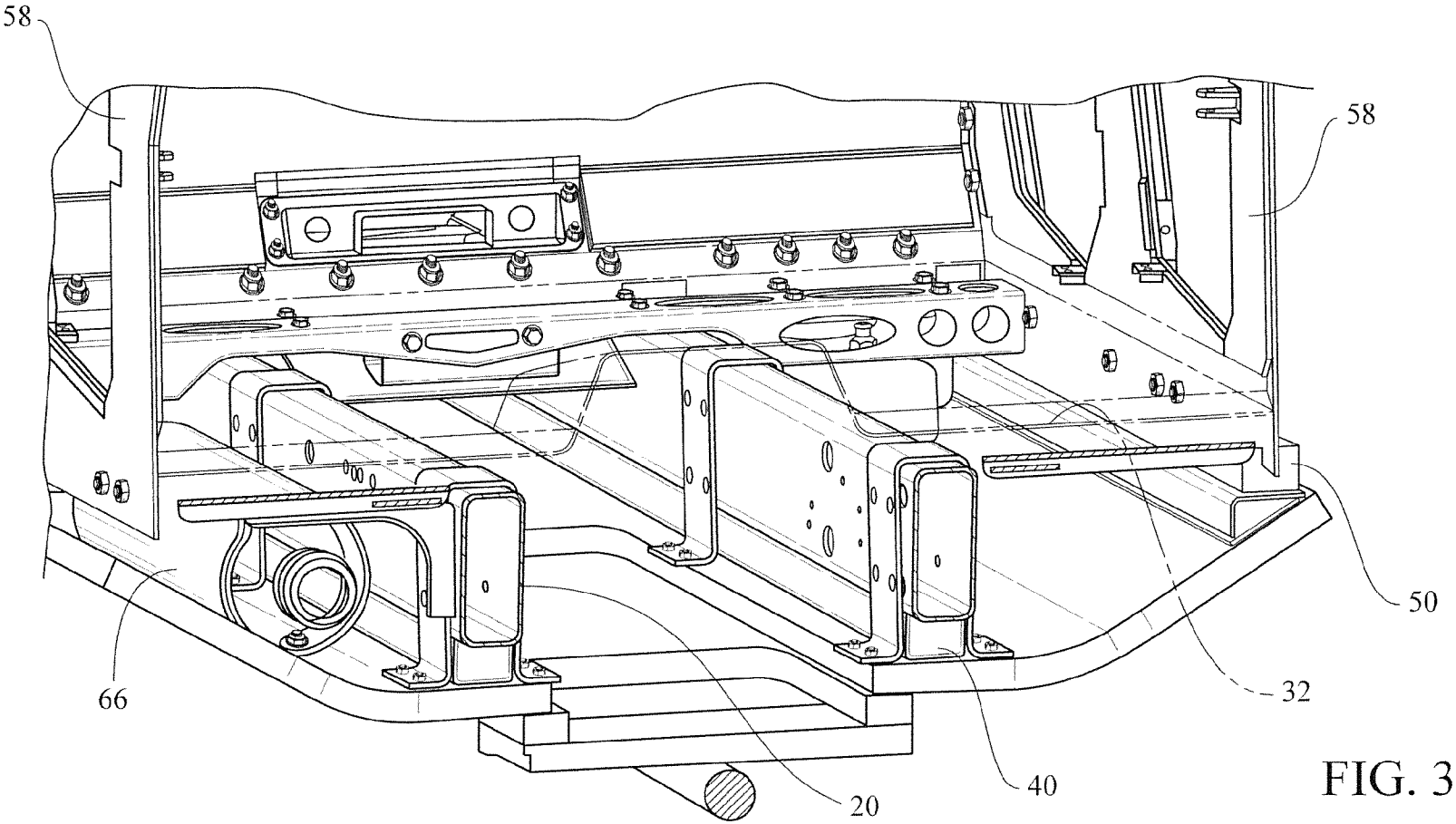
FIG. 3 is a perspective cut-away view showing the shield, the frame members, the side walls, the floor (in phantom), other portions of the cab and the automotive components.

FIG. 3 shows a blast shield 30 which is a plate of underbody armor in the form of a truncated V plate attached to fore frame sections 20. Shield 30 is in a position directly beneath cab floor 32; it is preferred that the blast shield cover the whole floor of cab 12 but not extend under payload area 14. The structure of the blast shield and associated components is best viewed in FIG. 2, wherein it can be seen that shield 30 has an overall shallow V cross section or a so-called truncated V cross section. Shield 30 has a flat middle zone 34 which is parallel to the surface 6 (FIG. 1) on which vehicle 8 is standing. Shield 30 also has two lateral zones 36 adjacent middle zone 34 and integrally formed therewith, the lateral zones being angled upward or away from the ground so as to form the sides of the shallow-V– plate cross section. It is preferred that shield 30 have a truncated V or shallow V configuration so as to avoid having the vertex of a purely V shaped structure projecting closer to the ground than does shield 30. Explosions on the ground from land mines or IEDs (improvised explosive devices) are thus further removed from the shield so that the shield experiences less blast force from these explosions and ultimately causes less blast force from the explosion to be transferred to the occupants of a vehicle on which shield 30 is installed.

Figure 5:
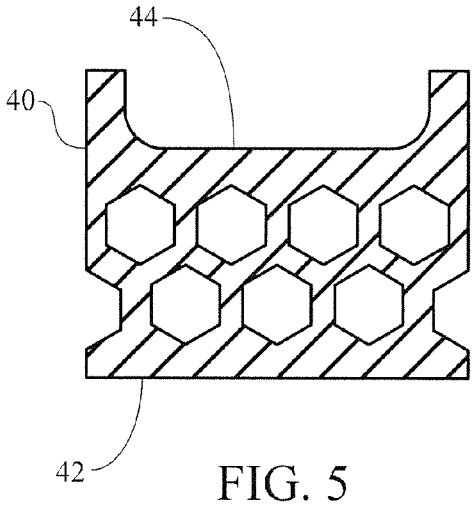
FIG. 5 is a cross sectional view of the elastomeric isolator associated with the frame members.
Figure 6:
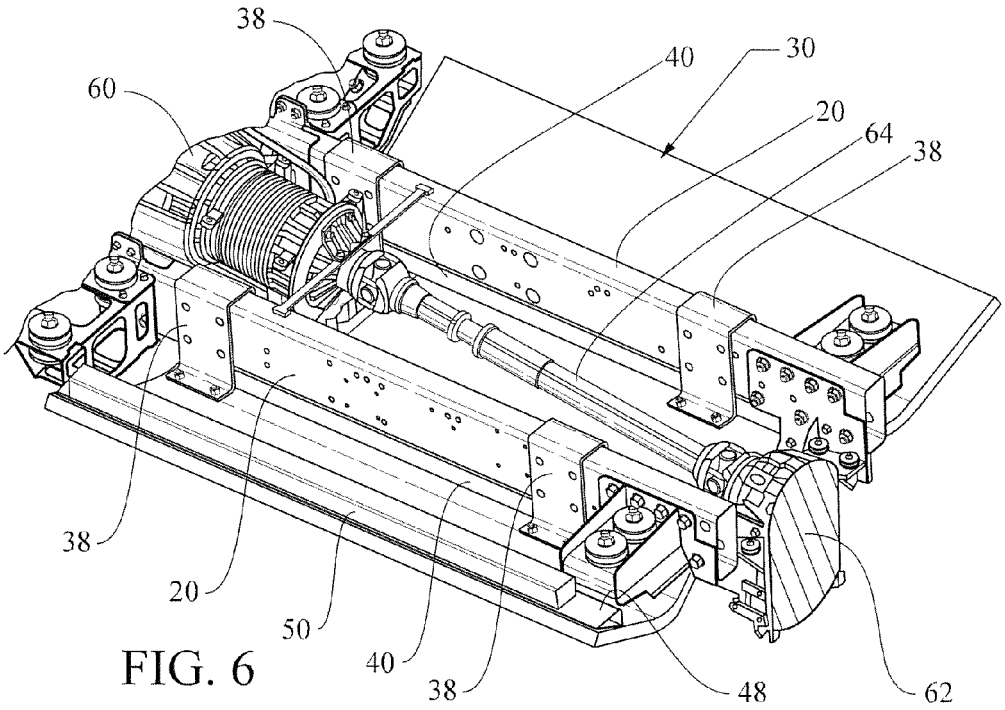
FIG. 6 is a perspective view of the shield and components disposed on or directly above it.

Affixed upon on the upper surface of shield 30 are four brackets or straps 38 by which the shield is attached to frame member sections 20, as perhaps best seen in FIG. 6. Straps 38 are typically made of steel and form openings with shield 30, through which pass elastomeric frame isolators 40. Isolators 40 have a cross section as seen in FIG. 5 and have a base 42 which faces against the upper surface of shield 30. Isolators 40 define an upper channel 44 seating frame member sections 20 and optionally define a plurality of elongate voids or through holes 46 to allow frame isolators 40 to be compressed relatively easily as the voids or holes collapse. Isolators 40 still deform once the holes or voids collapse, albeit at much higher loads.

The compressibility of isolators 40 enhances vehicle performance in one respect. During vehicle operation frame members 18 twist or bend, particularly if the vehicle is traversing rough terrain. Shield 30 is a rigid plate of armor and if it is affixed solidly to the frame members, the frame members may be stiffened more than is desired for optimum vehicle travel. Isolators 40 prevent shield 30 from inhibiting the normal deformation of the frame members during vehicle travel and allow installation of shield 30 on a vehicle without modifying the vehicle frame.

Figure 4:
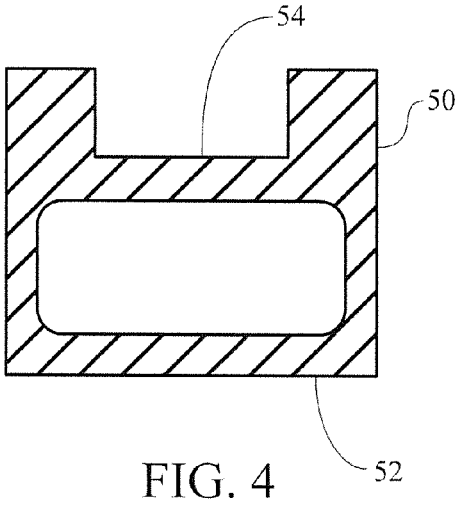
FIG. 4 is a cross sectional view of the elastomeric isolator associated with the side walls of the cab.

Fixed along the outer edges of lateral zones 36 and forming part of the shield are elongate, triangularly cross-sectioned shoulders 48. The shoulders stiffen and strengthen shield 30 and also support elastomeric wall isolators 50 whose cross section is shown in FIG. 4. The bottom 52 of isolator 50 faces against shoulder 48 and has a top channel 54. In conjunction with FIG. 6 it will be seen that side walls 58 of cab 12 are seated in channels 54 of wall isolators 50. Fixed to sidewalls 58 and spanning the distance between them is cab floor 32, so that the isolators' cushioning of sidewalls 58 affords shock absorption for the floor as well. Isolator 50 defines one or more enclosed voids or else forms a through-aperture 56 such that isolator 50 is essentially a tube with a channel along its top, as seen in FIGS. 3 and 4. Aperture 56 allows isolator 50 to be compressed relatively easily as the aperture collapses. Isolator 50 continues to deform after the aperture collapses, although isolator 50 does so at much higher loads.

As best seen in FIGS. 3 and 6, various drive train components are disposed between fore frame member sections 20 upon or just above plate 30. Typically, the drive train components will include a transmission 60, a transfer case 62 and a drive shaft 64 connected therebetween. Transmission 60 is affixed to frame member sections 20 in conventional fashion, typically by bolts (not shown). In addition, transmission 60 can be further secured to sections 20 by a stay 61 welded or otherwise fastened to sections 20 and transmission 60. Transfer case 62 is also fixed to sections 20, typically by means of bolts (again not shown) although another conventional fastening technique may be used. Depending on the type of vehicle on which shield 30 is installed, such automotive components as differentials, auxiliary power units, bilge pumps, drive motors for amphibious operations, batteries or other automotive components can be affixed to fore frame member sections 20. Transmissions, transfer cases, differentials, bilge pumps, amphibious drive motors and other automotive components that are not part of vehicle frame or vehicle body are sometimes referred to in blast mitigation parlance simply as "automotives," or can be called "automotive components" for convenience.

The pair of frame isolators 40, the pair of wall isolators 50 and a set of cab mounts 24 all work together to cushion cab 12 and floor 32 in a specially coordinated manner. The two isolator pairs are designed such that the distance which the wall isolators collapse is equal to the combined collapsing distance of the frame isolators and the cab mounts. Thus when an on-ground or under-vehicle blast occurs, the loads from the blast shield are divided so as to travel along two separate force paths to floor 32. The first force path is from the shield through frame isolators 40, fore frame sections 20, cab mounts 24 and thence through brackets 28 to floor 32. The second force path is from the shield, through isolators 50, through side walls 58 and thence to floor 32. Because of the particular design of the isolators and cab mounts, loads from the shield will arrive at different zones of floor 32. This avoids so-called asymmetrical loading, wherein the whole load from shield 30 arrives solely through one edge of the floor or from a single zone of the floor. Asymmetrical loading of the floor increases its oscillatory motion, which is a key cause of injury to the feet and lower limbs of vehicle occupants whose feet touch the floor.

In addition, the blast forces transmitted to frame members accelerate the automotive components (engine transmission, transfer case, differentials) and the payload area 14. By routing the force through the isolators and cab mounts, the loading on the floor is reduced by the inertia of the automotive components and payload area being accelerated before the floor. The aforementioned dual path distribution of the floor loading and the load dampening effect of the automotive components minimizes the oscillatory movement of the floor.

Specifically as to the effect of the payload area's inertia, it will be noted that payload area 14 is less cushioned that the cab 12. That is, cab mounts 24 are thicker, or greater in vertical dimension, than cargo area mounts 26; cab mounts 24 are also softer, or more compliant, than cargo area mounts 26; and under equal force, mounts 26 fully compress before mounts 24. This is one factor causing cargo area 14 to be accelerated by frame members 18 before these frame members accelerate cab 12 in the event of an on-ground or under-vehicle blast. Another factor causing cargo area 14 to be accelerated first is simply the shock absorption provided by isolators 40 and 50. Because cargo area 14 is accelerated by the frame members before cab 12 is so accelerated, the inertia of cargo area 14 serves to decrease the load on cab 12 when an under-vehicle explosion occurs and consequently the inertia of cargo area 14 helps reduce the oscillation of floor 32.

Various alterations and modifications will become apparent to those skilled in the art without departing from the scope and spirit of this invention and it is understood this invention is limited only by the following claims.

What is claimed is:

1. A mechanism for protecting occupants of a vehicle from floor oscillation resulting from an explosion under the vehicle, comprising:

frame members of the vehicle;

a cab of the vehicle having side walls and a floor fixed to the side walls;

cab mounts having elastomeric bodies, the cab mounts disposed between the frame members and the cab;

a shield disposed below the floor of the cab;

first elastomeric isolators disposed between the shield and the frame members; and second elastomeric isolators disposed between the shield and the side walls;

wherein the distance the second isolators collapse is equal to the combined collapsing distance of the first isolators and the cab mounts, whereby explosive loads experienced by the shield travel along separate force paths to the floor, thereby decreasing oscillation of the floor.

2. The mechanism of claim 1 further comprising automotive components affixed to the frame members, the automotive components disposed above the shield.

3. The mechanism of claim 1 wherein the shield has a truncated V configuration.

4. The mechanism of claim 1 wherein the isolators are elongate members having a hole extending therethrough.

5. The mechanism of claim 1 wherein the isolators are elongate members having a void defined therein.

6. The mechanism of claim 1 wherein the first isolators have means for seating the frame members thereon and the second isolators have means for seating the side walls thereon.

7. A mechanism for protecting occupants of a vehicle from floor oscillation resulting from an explosion under the vehicle, comprising:

frame members of the vehicle;

a cab of the vehicle having side walls and a floor fixed to the side walls;

cab mounts having first elastomeric bodies, the cab mounts disposed between the frame members and the cab;

a shield disposed below the floor of the cab;

first elastomeric isolators disposed between the shield and the frame members;

second elastomeric isolators disposed between the shield and the side walls;

wherein the distance the second isolators collapse is equal to the combined collapsing distance of the first isolators and the cab mounts, whereby explosive loads experienced by the shield travel along separate force paths to the floor so as to decrease oscillation of the floor;

a payload area of the vehicle; and payload area mounts having second elastomeric bodies wherein the first elastomeric bodies are thicker and softer than the second elastomeric bodies, thereby increasing the tendency of the explosion under the vehicle accelerate the payload area before affecting the cab.

8. The mechanism of claim 7 further comprising automotive components affixed to the frame members, the automotive components disposed above the shield.

9. The mechanism of claim 7 wherein the shield has a truncated V configuration.

10. The mechanism of claim 7 wherein the isolators are elongate members having a hole extending therethrough.

11. The mechanism of claim 7 wherein the first isolators have means for seating the frame members thereon and the second isolators have means for seating the side walls thereon.

12. An improved mechanism for protecting occupants of a vehicle from floor oscillation resulting from an explosion under the vehicle, comprising:

a pair of frame members of the vehicle, each of the frame members having a fore frame section and an aft frame section;

a cab of the vehicle having side walls and a floor fixed to the side walls;

a payload area of the vehicle;

cab mounts having first elastomeric bodies, the cab mounts disposed between the fore frame sections and the cab;

payload area mounts having second elastomeric bodies, the payload area mounts disposed between the aft frame sections and the payload area, the first elastomeric bodies being softer and thicker than the second elastomeric bodies;

wherein relative motion between the cab and the frame members is independent of relative motion between the payload area and the frame members;

a shield disposed below the floor of the cab, the shield comprised of armor material and having a truncated V shape;

first elastomeric isolators disposed between the shield and the fore frame sections;

shoulders on the lateral edges of the shield disposed along and beneath the side walls of the cab;

second elastomeric isolators on the shoulders disposed between the shoulders and the side walls;

means on the first isolators for seating the fore frame sections on the first isolators; and means on the second isolators for seating the side walls on the second isolators;

automotive components affixed to the fore frame sections;

wherein the distance the second isolators collapse is equal to the combined collapsing distance of the first isolators and the cab mounts, whereby explosive loads experienced by the shield travel along separate force paths to the floor so as to decrease oscillation of the floor.

13. The mechanism of claim 12 wherein the isolators are elongate members having a hole extending lengthwise therethrough.

14. The mechanism of claim 12 wherein the isolators are elongate members having a void defined therein.

15. The mechanism of claim 12 wherein the shield is a rigid body.

16. The mechanism of claim 12 further comprising elongate stiffening shoulders on the lateral edges of the shield, the shoulders interfacing the bottom of the second isolators.

17. The mechanism of claim 12 wherein the automotive components comprise a vehicle transmission and a transfer case.

* * * * *